US010458371B2

(12) United States Patent
Lee et al.

(10) Patent No.: US 10,458,371 B2
(45) Date of Patent: Oct. 29, 2019

(54) EGR COOLER

(71) Applicants: HYUNDAI MOTOR COMPANY, Seoul (KR); KIA MOTORS CORPORATION, Seoul (KR); Korens Co., Ltd., Yangsan-si, Gyeongsangnam-do (KR)

(72) Inventors: Joon Myung Lee, Seoul (KR); Jeon Jin Park, Suwon-si (KR); Sung Soo Kim, Incheon (KR); Kyoung Ik Jang, Yongin-si (KR); Hyung Geun Cho, Busan (KR)

(73) Assignees: Hyundai Motor Company, Seoul (KR); Kia Motors Corporation, Seoul (KR); Korens Co., Ltd., Yangsan-si, Gyeongsangnam-do (KR)

( * ) Notice: Subject to any disclaimer, the term of this patent is extended or adjusted under 35 U.S.C. 154(b) by 211 days.

(21) Appl. No.: 15/808,315

(22) Filed: Nov. 9, 2017

(65) Prior Publication Data

US 2018/0291844 A1 Oct. 11, 2018

(30) Foreign Application Priority Data

Apr. 10, 2017 (KR) ..... 10-2017-0046247

(51) Int. Cl.

| | |
|---|---|
| ***F02M 26/32*** | (2016.01) |
| ***F02M 26/27*** | (2016.01) |
| ***F28D 7/16*** | (2006.01) |
| ***F28F 1/40*** | (2006.01) |
| ***F28D 21/00*** | (2006.01) |
| *F28F 1/02* | (2006.01) |

(52) U.S. Cl.

CPC ..... *F02M 26/32* (2016.02); *F02M 26/27* (2016.02); *F28D 7/1692* (2013.01); *F28D 21/0003* (2013.01); *F28F 1/40* (2013.01); *F28F 2001/027* (2013.01)

(58) Field of Classification Search

CPC .... F02M 26/32; F02M 26/27; F28D 21/0003; F28D 7/1692; F28F 1/40

See application file for complete search history.

(56) References Cited

U.S. PATENT DOCUMENTS

2006/0048921 A1* 3/2006 Usui ..... F28D 7/1684 165/109.1
2008/0011464 A1* 1/2008 Oofune ..... F28D 7/1684 165/157

FOREIGN PATENT DOCUMENTS

KR 10-0925816 B1 11/2009
KR 10-2013-0059784 A 6/2013

* cited by examiner

*Primary Examiner* — Xiao En Mo
(74) *Attorney, Agent, or Firm* — Morgan, Lewis & Bockius LLP

(57) ABSTRACT

An EGR cooler includes a housing having coolant inlet and outlet, through which coolant flows into and out of the housing, and having gas inlet and outlet through which exhaust gas flows into and out of the housing, a plurality of first tubes provided in the housing while one end of each of the first tubes communicates with the gas inlet and the other end thereof communicates with one end of a connection passage, a plurality of second tubes provided in the housing while one end of each of the second tubes communicates with the gas outlet and the other end thereof communicates with the other end of the connection passage, and first and second cooling fins inserted into the respective first and second tubes, wherein the gas inlet has a larger cross-sectional area than the gas outlet.

10 Claims, 5 Drawing Sheets

EGR COOLER

CROSS REFERENCE TO RELATED APPLICATION

The present application claims priority of Korean Patent Application No. 10-2017-0046247 filed on Apr. 10, 2017, the entire contents of which is incorporated herein for all purposes by reference.

BACKGROUND OF THE INVENTION

Field of the Invention

The present invention relates to an Exhaust Gas Recirculation EGR cooler capable of optimizing a differential pressure of EGR gas and having optimized cooling efficiency.

Description of the Related Art

In general, the Exhaust Gas Recirculation EGR system is a system that recirculates a portion of exhaust gas back to an intake system to increase $CO_2$ gas concentration in suction air and lower the temperature in a combustion chamber, thereby reducing NOx gas emission.

The system includes an EGR cooler that cools exhaust gas using coolant. The EGR cooler should be made of a heat-resistant material since there is a need to cool exhaust gas having a temperature of about 700° C. to a temperature of 150 to 200° C., should be designed to have a compact structure for installation in a vehicle, and a drop in pressure in the EGR cooler should be minimized for supply of a proper amount of EGR. In addition, the EGR cooler should be made of an anticorrosion material since it tends to be corroded by sulfuric acid contained in condensate because of sulfide components in fuel due to the occurrence of condensation from exhaust gas during heat exchange, and should have a certain mechanical strength since a mechanical load is applied to the EGR cooler due to pulsation of exhaust gas.

In recent years, there have been developed technologies for more compactly designing an engine to minimize an engine room and sufficiently secure a vehicle interior space occupied by a driver for the convenience of occupants.

In addition, EGR gas for reducing NOx has been increasingly used due to an increased interest in environment and reinforcement of emission control.

Accordingly, the EGR cooler is manufactured to include a variable exhaust passage therein so as to have a compact structure while cooling exhaust gas. In this case, it is difficult to cope with the regulation required to use a large amount of EGR gas since the differential pressure of EGR gas is increased, and it is difficult to optimize the differential pressure of the EGR gas and the performance of the EGR cooler since the differential pressure is in inverse proportion to the performance due to the characteristics of the cooler.

The foregoing is intended merely to aid in the understanding of the background of the present invention, and is not intended to mean that the present invention falls within the purview of the related art that is already known to one of ordinary skills in the art.

SUMMARY OF THE INVENTION

Accordingly, the present invention has been made keeping in mind the above problems occurring in the related art, and the present invention is intended to propose an EGR cooler having an improved structure to optimize a differential pressure of EGR gas and have optimized cooling efficiency.

In accordance with an aspect of the present invention, an EGR cooler includes a housing having coolant inlet and outlet, through which coolant flows into and out of the housing, and having gas inlet and outlet through which exhaust gas flows into and out of the housing, a plurality of first tubes provided in the housing while one end of each of the first tubes communicates with the gas inlet and the other end thereof communicates with one end of a connection passage, a plurality of second tubes provided in the housing while one end of each of the second tubes communicates with the gas outlet and the other end thereof communicates with the other end of the connection passage, a plurality of first cooling fins inserted into each of the first tubes, and a plurality of second cooling fins inserted into each of the second tubes, wherein the gas inlet has a larger cross-sectional area than the gas outlet.

The gas inlet and the gas outlet may be disposed in parallel to each other at one side of the housing, the first tubes may allow the exhaust gas supplied from the gas inlet to flow in one direction, the connection passage may have a U shape to reverse a flow direction of the exhaust gas supplied from the first tubes, and the second tubes may allow the exhaust gas supplied from the connection passage to flow in the other direction and be discharged to the gas outlet.

The number of first tubes may be more than that of second tubes, and the first tubes may have a cross-sectional area equal to or larger than the second tubes.

The gas inlet may have a cross-sectional area of 1.3 to 2 times the gas outlet.

The first and second cooling fins may have a square wave shape in cross-section in a width direction thereof, and may continue to be flat in a longitudinal direction thereof.

The first and second cooling fins may have a square wave shape in cross-section in a width direction thereof, and may have a sine wave shape with a regular pitch in a longitudinal direction thereof.

The first cooling fins may have a smaller radius of curvature than the second cooling fins in the sine wave shape formed in the longitudinal direction thereof.

The first and second cooling fins may have a square wave shape in cross-section in a width direction thereof, the first cooling fins may have a sine wave shape with a regular pitch in a longitudinal direction thereof, and the second cooling fins may continue to be flat in a longitudinal direction thereof.

The first and second cooling fins may have a square wave shape in cross-section in a width direction thereof, and may be provided as an offset fin in which centers of ridges of longitudinal adjacent rows are spaced at regular intervals from each other to form slits in which a fluid flows.

The first and second cooling fins may have a square wave shape in cross-section in a width direction thereof, the first cooling fins may be provided as an offset fin in which centers of ridges of longitudinal adjacent rows are spaced at regular intervals from each other to form slits in which a fluid flows, and the second cooling fins may continue to be flat in a longitudinal direction thereof.

As apparent from the above description, since the differential pressure of EGR gas is reduced in accordance with the EGR cooler having the above-mentioned structure, it is possible to provide an amount of EGR gas that satisfies emission control.

In addition, since the EGR cooler has a compact structure and improved cooling performance, it is possible to improve merchantability of vehicles.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF PREFERRED EMBODIMENTS

An EGR cooler according to the preferred embodiments of the present invention will be described below with reference to the accompanying drawings.

Figure 1:
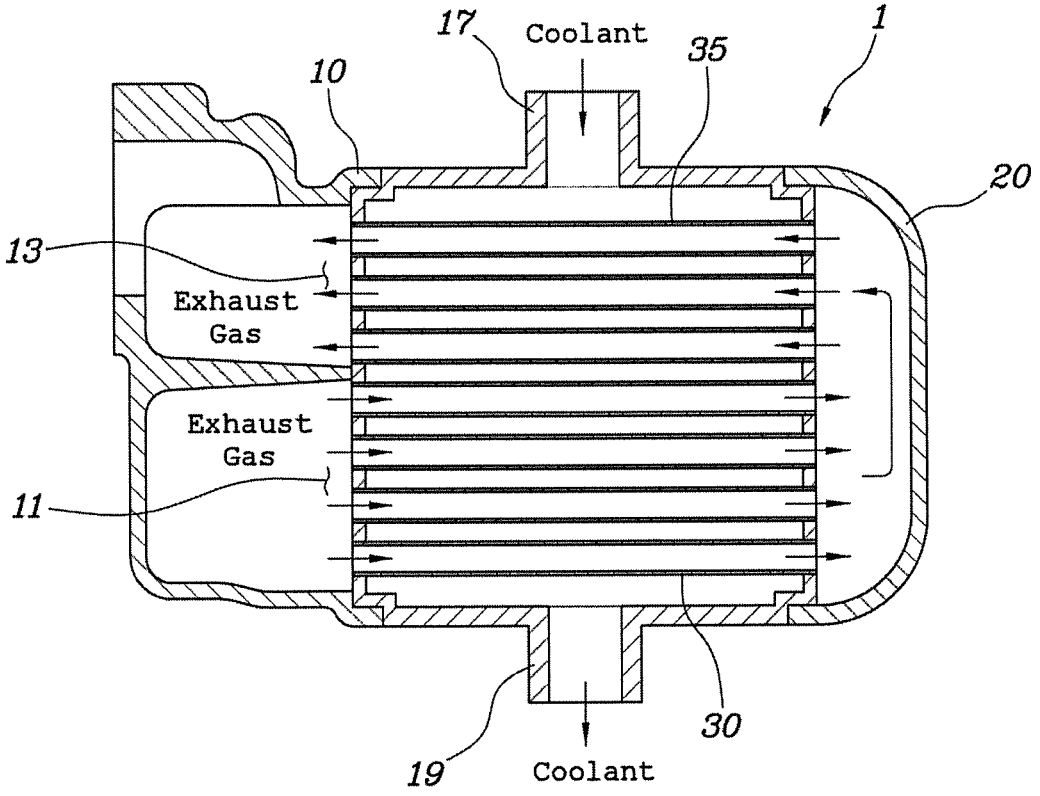
FIG. 1 shows a cross-sectional view illustrating an EGR cooler according to an embodiment of the present invention.

FIG. 1 shows a cross-sectional view illustrating an Exhaust Gas Recirculation EGR cooler according to an embodiment of the present invention.

Referring to FIG. 1, the EGR cooler 1, according to an embodiment of the present invention, includes a housing 10 that has coolant inlet and outlet 17 and 19, respectively, through which coolant flows into and out of the housing 10, and has gas inlet and outlet 11 and 13 through which exhaust gas flows into and out of the housing 10, a plurality of first tubes 30 that is provided in the housing 10 while one end of each of the first tubes 30 communicates with the gas inlet 11 and the other end thereof communicates with one end of a connection passage 20, a plurality of second tubes 35 that is provided in the housing 10 while one end of each of the second tubes 35 communicates with the gas outlet 13 and the other end thereof communicates with the other end of the connection passage 20, a plurality of first cooling fins 33 (FIG. 2) that is inserted into each of the first tubes 30, and a plurality of second cooling fins 37 (FIG. 2) that is inserted into each of the second tubes 35, wherein the gas inlet 11 has a larger cross-sectional area than the gas outlet 13.

That is, the EGR cooler 1 is configured to include the first and second tubes 30 and 35 inserted into the housing 10 such that exhaust gas flows therein and to perform heat exchange while coolant flows around the first and second tubes 30 and 35, and may thus perform a function of cooling exhaust gas.

Here, the housing 10 defines a chamber in which coolant flows, and the first and second tubes 30 and 35 are arranged to pass through the chamber. Thus, the exhaust gas flowing in the first and second tubes 30 and 35 is cooled by coolant therearound, and the exhaust gas is not mixed with the coolant.

Meanwhile, the first and second tubes 30 and 35 are provided therein with the first and second cooling fins 33 and 37, respectively, and have an enlarged area in which exhaust gas exchanges heat with coolant, thereby improving performance for cooling exhaust gas.

In particular, the present invention is characterized in that the gas inlet 11 has a larger cross-sectional area than the gas outlet 13.

The EGR cooler is preferably configured such that the differential pressure of exhaust gas passing through the EGR cooler is low to satisfy emission control. Accordingly, since the exhaust gas flowing to the gas inlet 11 is high-temperature and high-pressure gas and the exhaust gas flowing to the gas outlet 13 is low-temperature and low-pressure gas, the gas inlet 11 required for high cooling in the EGR cooler is formed to have a large cross-sectional area, thereby improving performance for cooling exhaust gas. In addition, since a space in which exhaust gas flows is increased, it is possible to decrease the differential pressure of exhaust gas.

Although the coolant inlet 17 and the coolant outlet 19 are illustrated to be stacked on each other in FIG. 1, they may be designed by adjusting the application positions thereof around the housing 10 according to the designer or the vehicle type.

In more detail, the present invention is characterized in that the gas inlet 11 and the gas outlet 13 are disposed in parallel to each other at one side of the housing 10, the first tubes 30 allow the exhaust gas supplied from the gas inlet 11 to flow in one direction (arrows in the first tubes 30 in FIG. 1), the connection passage 20 has a U shape to reverse the flow direction (arrows in FIG. 1 in the U-shaped connection passage 20) of the exhaust gas supplied from the first tubes 30, and the second tubes 35 allow the exhaust gas supplied from the connection passage 20 to flow in the other direction (arrows in the second tubes 35 of FIG. 1) and be discharged to the gas outlet 13.

That is, it can be seen that the first tubes 30 communicating with the gas inlet 11 and the second tubes 35 communicating with the gas outlet 13 are vertically arranged in parallel to each other, the housing 10 encloses them, and the U-shaped connection passage 20 connecting the first and second tubes 30 and 35 is coupled to the other side of the housing 10 in the EGR cooler 1 according to the embodiment of the present invention, as illustrated in FIG. 1.

Here, since the connection passage 20 is provided separately from the first and second tubes 30 and 35 and is coupled to the other side of the housing 10, as illustrated in FIG. 1, the first tubes 30 may communicate with the second tubes 35 to thereby reverse the flow direction (arrows) of exhaust gas.

In this case, the present invention is characterized in that the number of first tubes 30 is more than that of second tubes 35, and the first tubes 30 have a cross-sectional area equal to or larger than the second tubes 35.

That is, if the number of first tubes 30 is less than that of second tubes 35 and the first tubes 30 have a smaller cross-sectional area than the second tubes 35 even though the gas inlet 11 is larger than the gas outlet 13 in the embodiment of the present invention, it is impossible to achieve the cooling performance of the EGR cooler and the differential pressure of exhaust gas which are required by a designer.

Accordingly, the EGR cooler is configured such that the first tubes 30 have a cross-sectional area equal to or larger than the second tubes 35 and the number of first tubes 30 is more than that of second tubes 35. Thus, it is possible to effectively cool the high-temperature and high-pressure exhaust gas flowing in the first tubes 30 and to reduce the differential pressure of exhaust gas.

Specifically, the gas inlet 11 may have a cross-sectional area of 1.3 to 2 times the gas outlet 13.

In an example of the present invention, the first and second cooling fins 33 and 37 may have a square wave shape in cross-section in the width direction thereof, and may continue to be flat in the longitudinal direction thereof.

That is, since the first and second cooling fins 33 and 37 have a square wave shape in cross-section in the width direction thereof, it is possible to increase an area for heat exchange by contact of the exhaust gas flowing into the first and second tubes 30 and 35 with the first or second cooling fins 33 or 37.

However, the first and second cooling fins 33 and 37 are provided as a flat fin in the longitudinal direction thereof, it is possible to reduce a loss in pressure of exhaust gas occurring when exhaust gas flows in the first and second tubes 30 and 35.

Figure 2:
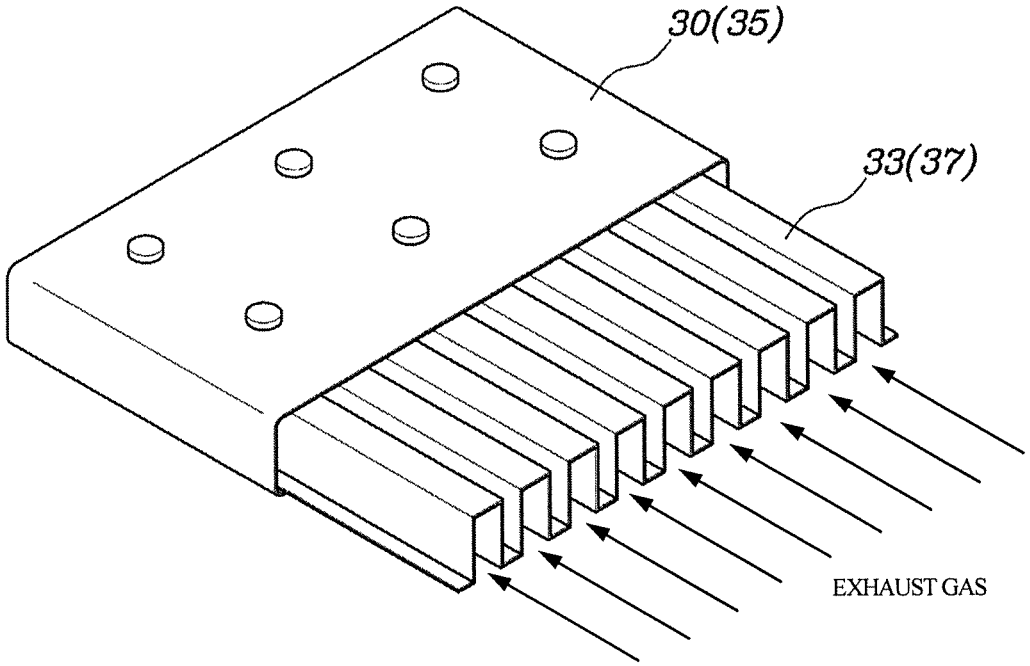
FIG. 2 shows a perspective view illustrating first or second cooling fins having a flat shape in the longitudinal direction thereof according to the embodiment of the present invention.

FIG. 2 is a perspective view illustrating the first or second cooling fins 33 or 37 having a flat shape in the longitudinal direction thereof according to the embodiment of the present invention. That is, it can be seen that the cooling fins inserted into the tubes have a square wave shape in the width direction thereof, and have a flat shape in the longitudinal direction thereof.

In another example of the present invention, the first and second cooling fins 33 and 37 may have a square wave shape in cross-section in the width direction thereof, and may have a sine wave shape with a regular pitch in the longitudinal direction thereof.

Figure 3:
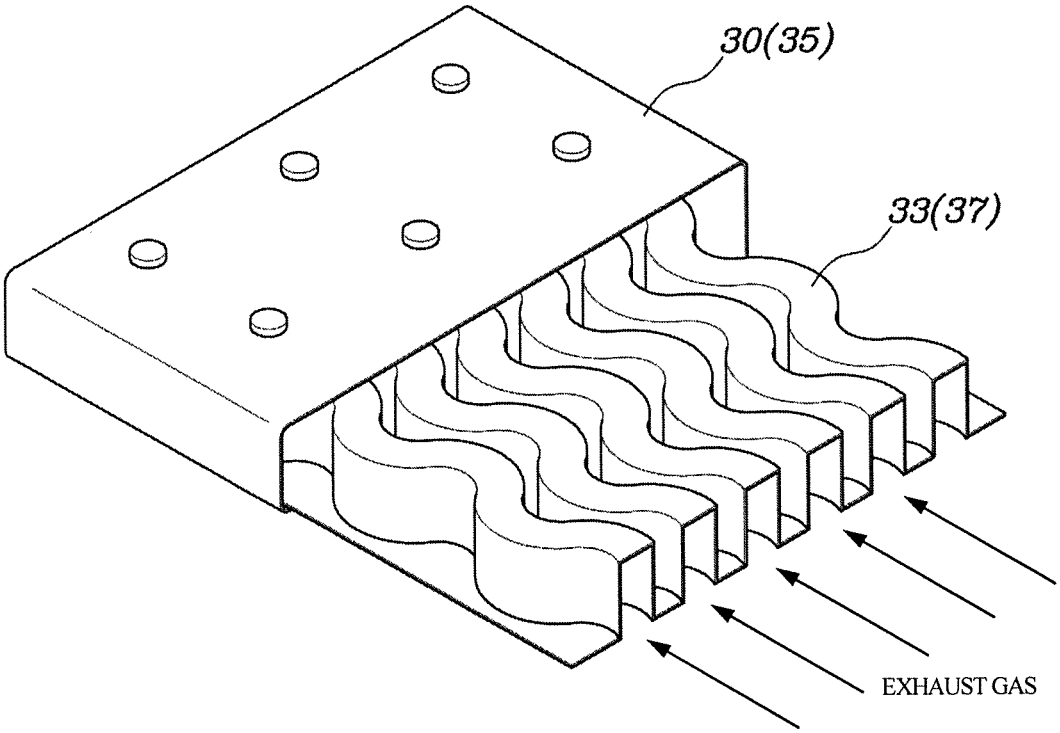
FIG. 3 shows a perspective view illustrating first or second cooling fins having a sine wave shape in the longitudinal direction thereof according to the embodiment of the present invention.

FIG. 3 is a perspective view illustrating the first or second cooling fins 33 or 35 having a sine wave shape in the longitudinal direction thereof according to the embodiment of the present invention. That is, it can be seen that the cooling fins inserted into the tubes have a square wave shape in the width direction thereof, and have a sine wave shape in the longitudinal direction thereof.

As such, when the first and second cooling fins 33 and 37 have a sine wave shape in the longitudinal direction thereof, turbulence occurs while exhaust gas flows, thereby improving the cooling performance of the EGR cooler 1. However, since the differential pressure of exhaust gas is increased due to occurrence of turbulence, it is possible to depart from emission control.

In addition, the first cooling fins 33 have a smaller radius of curvature than the second cooling fins 37 in the sine wave shape fouled in the longitudinal direction thereof.

Figure 4A:
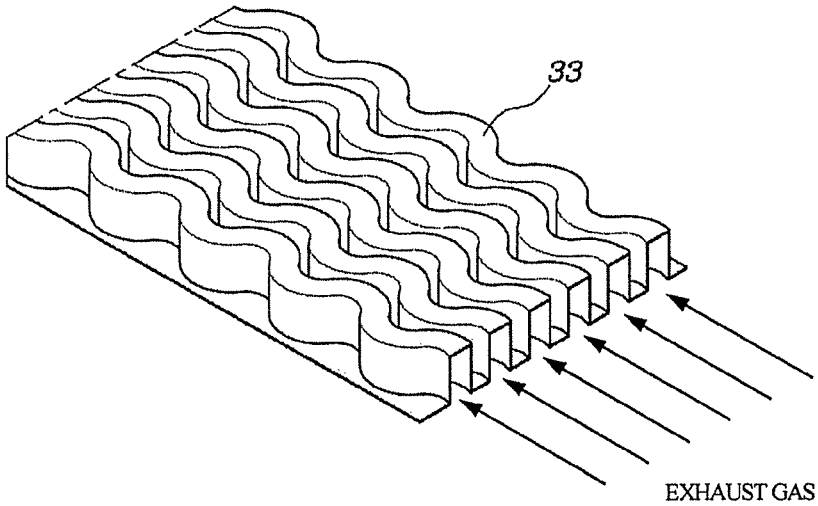
FIGS. 4A and 4B show a perspective view illustrating first and second cooling fins having different radii of curvature according to the embodiment of the present invention.
Figure 4B:
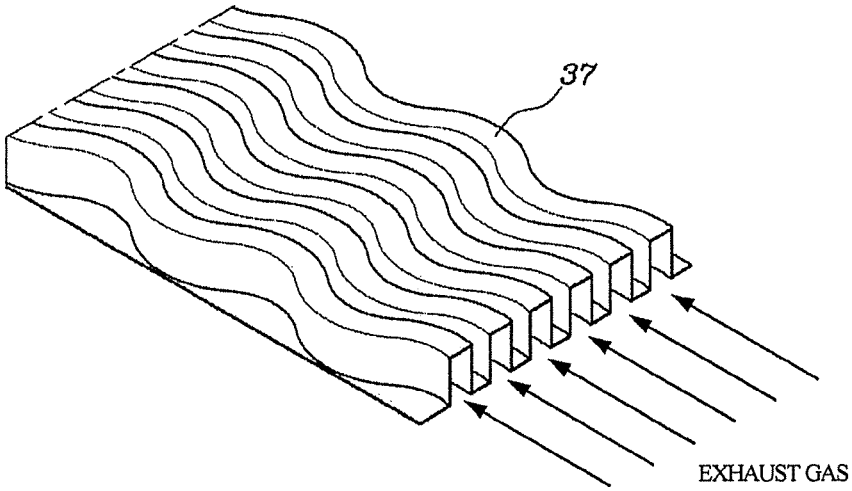

FIGS. 4A and 4B are perspective views illustrating first and second cooling fins having different radii of curvature according to the embodiment of the present invention. When comparing FIG. 4A with FIG. 4B, it can be seen that the first cooling fins 33 have a smaller radius of curvature than the second cooling fins 37 and have a smaller sinusoidal pitch than the second cooling fins 37 in the longitudinal direction thereof.

Accordingly, a large amount of turbulence occurs when exhaust gas flows along the first cooling fins 33, compared to when exhaust gas flows along the second cooling fins 37, thereby improving the cooling performance of the EGR cooler. A small amount of turbulence occurs when exhaust gas flows along the second cooling fins 37, compared to when exhaust gas flows along the first cooling fins 33, with the consequence that the cooling performance of the EGR cooler is lowered but the difference pressure of exhaust gas is effectively reduced. Therefore, it is possible to simultaneously achieve an improvement in the EGR cooler and a reduction in the differential pressure of exhaust gas.

In a still another example of the present invention, the first and second cooling fins 33 and 37 may have a square wave shape in cross-section in the width direction thereof, the first cooling fins 33 may have a sine wave shape with a regular pitch in the longitudinal direction thereof, and the second cooling fins 37 may continue to be flat in the longitudinal direction thereof.

That is, it is important to cool the high-temperature and high-pressure exhaust gas flowing in the first tubes 30. Accordingly, the first cooling fins 33 have a sine wave shape in the longitudinal direction thereof.

On the other hand, it is important to reduce the differential pressure of exhaust gas by decreasing a loss in pressure of the low-temperature and low-pressure exhaust gas flowing in the second tubes 35. Accordingly, the second cooling fins 37 have a flat shape in the longitudinal direction thereof.

As a result, the EGR cooler 1 according to embodiment of the present invention can have improved cooling efficiency and effectively prevent limitations on emission control due to an excessive increase in the differential pressure of exhaust gas.

Figure 5:
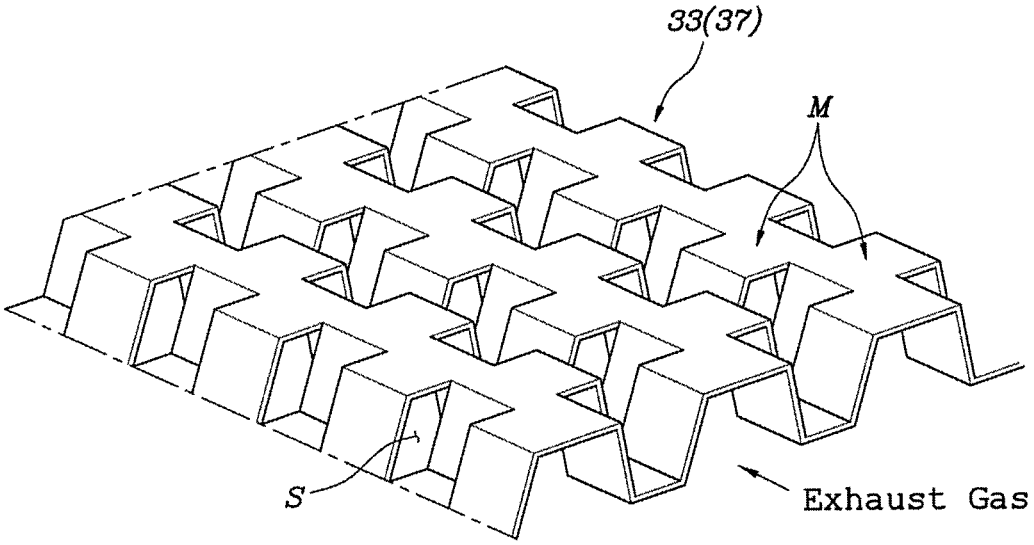
FIG. 5 shows a perspective view illustrating first or second cooling fins as an offset fin according to the embodiment of the present invention.

FIG. 5 is a perspective view illustrating first or second cooling fins as an offset fin according to the embodiment of the present invention.

Referring to FIG. 5, the first and second cooling fins 33 and 37 may have a square wave shape in cross-section in the width direction thereof, and may be provided as an offset fin in which the centers of ridges M of longitudinal adjacent rows are spaced at regular intervals from each other to form slits S in which a fluid flows.

That is, all of the first and second cooling fins 33 and 37 are provided as an offset fin, thereby enlarging an area for heat exchange between the exhaust gas flowing in the first and second tubes 30 and 35 and the cooling fins. Thus, it is possible to maximize the cooling efficiency of the EGR cooler 1.

In a further example of the present invention, the first and second cooling fins 33 and 37 may have a square wave shape in cross-section in the width direction thereof, the first cooling fins 33 may be provided as an offset fin in which the centers of ridges M of longitudinal adjacent rows are spaced at regular intervals from each other to form slits S in which a fluid flows, and the second cooling fins 37 may continue to be flat in the longitudinal direction thereof.

That is, since it is important to cool the high-temperature and high-pressure exhaust gas flowing in the first tubes 30, the first cooling fins 33 are provided as an offset fin. On the other hand, since it is important to reduce the differential pressure of exhaust gas by decreasing a loss in pressure of the low-temperature and low-pressure exhaust gas flowing in the second tubes 35, the second cooling fins 37 are provided as a flat fin in the longitudinal direction thereof.

As a result, the EGR cooler 1 according to embodiment of the present invention can have improved cooling efficiency and effectively prevent limitations on emission control due to an excessive increase in the differential pressure of exhaust gas.

In accordance with the EGR cooler having the above-mentioned structure, since the differential pressure of EGR gas is reduced, it is possible to provide an amount of EGR gas that satisfies emission control.

In addition, since the EGR cooler has a compact structure and improved cooling performance, it is possible to improve merchantability of vehicles.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An EGR cooler comprising:

a housing having coolant inlet and outlet, through which coolant flows into and out of the housing, and having gas inlet and outlet through which exhaust gas flows into and out of the housing;

a plurality of first tubes provided in the housing while one end of each of the first tubes communicates with the gas inlet and the other end thereof communicates with one end of a connection passage;

a plurality of second tubes provided in the housing while one end of each of the second tubes communicates with the gas outlet and the other end thereof communicates with the other end of the connection passage;

a plurality of first cooling fins inserted into each of the first tubes; and a plurality of second cooling fins inserted into each of the second tubes, wherein the gas inlet has a larger cross-sectional area than the gas outlet.

2. The EGR cooler according to claim 1, wherein:

the gas inlet and the gas outlet are disposed in parallel to each other at one side of the housing;

the first tubes allow the exhaust gas supplied from the gas inlet to flow in one direction;

the connection passage has a U shape to reverse a flow direction of the exhaust gas supplied from the first tubes; and the second tubes allow the exhaust gas supplied from the connection passage to flow in the other direction and be discharged to the gas outlet.

3. The EGR cooler according to claim 1, wherein the number of first tubes is more than that of second tubes, and the first tubes have a cross-sectional area equal to or larger than the second tubes.

4. The EGR cooler according to claim 1, wherein the gas inlet has a cross-sectional area of 1.3 to 2 times the gas outlet.

5. The EGR cooler according to claim 1, wherein the first and second cooling fins have a square wave shape in cross-section in a width direction thereof, and continue to be flat in a longitudinal direction thereof.

6. The EGR cooler according to claim 1, wherein the first and second cooling fins have a square wave shape in cross-section in a width direction thereof, and have a sine wave shape with a regular pitch in a longitudinal direction thereof.

7. The EGR cooler according to claim 6, wherein the first cooling fins have a smaller radius of curvature than the second cooling fins in the sine wave shape formed in the longitudinal direction thereof.

8. The EGR cooler according to claim 1, wherein the first and second cooling fins have a square wave shape in cross-section in a width direction thereof, the first cooling fins have a sine wave shape with a regular pitch in a longitudinal direction thereof, and the second cooling fins continue to be flat in a longitudinal direction thereof.

9. The EGR cooler according to claim 1, wherein the first and second cooling fins have a square wave shape in cross-section in a width direction thereof, and are provided as an offset fin in which centers of ridges of longitudinal adjacent rows are spaced at regular intervals from each other to form slits in which a fluid flows.

10. The EGR cooler according to claim 1, wherein the first and second cooling fins have a square wave shape in cross-section in a width direction thereof, the first cooling fins are provided as an offset fin in which centers of ridges of longitudinal adjacent rows are spaced at regular intervals from each other to form slits in which a fluid flows, and the second cooling fins continue to be flat in a longitudinal direction thereof.

* * * * *